US005151063A

United States Patent [19]

Tanaka et al.

[11] Patent Number: 5,151,063

[45] Date of Patent: Sep. 29, 1992

[54] AIR CONDITIONING DISTRIBUTION SYSTEM

[75] Inventors: Ichiro Tanaka; Seiji Sasaki; Zen-ichi Kakubari; Osamu Kojima, all of Kohnan, Japan

[73] Assignee: Zexel Corporation, Japan

[21] Appl. No.: 592,131

[22] Filed: Oct. 3, 1990

[30] Foreign Application Priority Data

Oct. 3, 1989 [JP] Japan ..... 1-257154
Oct. 3, 1989 [JP] Japan ..... 1-257155
Oct. 3, 1989 [JP] Japan ..... 1-257156

[51] Int. Cl.[5] ..... F24F 7/08

[52] U.S. Cl. ..... 454/258; 454/292; 62/455

[58] Field of Search ..... 98/40.01, 40.05, 40.19, 98/31.6, 34.6; 62/441, 454, 455; 454/254, 258, 272

[56] References Cited

U.S. PATENT DOCUMENTS 2,191,141 2/1940 Grant ..... 98/31.6
2,206.858 7/1940 McKee ..... 98/34.6
2,302,818 11/1942 Turner ..... 98/31.6
2,938.449 5/1960 Newell, Jr. et al. ..... 98/40.19
2,987,258 6/1961 North ..... 98/40.01
3,949,522 4/1976 Kehl et al. ..... 98/40.19
4,659,236 4/1987 Hobbs ..... 236/94
4,955,997 9/1990 Robertson. III ..... 98/40.01

FOREIGN PATENT DOCUMENTS 0486695 9/1952 Canada ..... 98/31.6
0073027 4/1987 Japan ..... 98/31.6

*Primary Examiner*—Albert J. Makay
*Assistant Examiner*—William C. Doerrler
*Attorney, Agent, or Firm*—Ostrolenk, Faber, Gerb & Soffen

[57] ABSTRACT

An air conditioning system comprises an air conditioning unit, a blower for blowing conditioned air, a polygonal branch chamber of prescribed volume, a main duct with damper for delivering conditioned air from the blower to the polygonal branch chamber and branch ducts with dampers for delivering the conditioned air from the polygonal branch chamber to a plurality of discrete spaces. The polygonal branch chamber ensures quiet operation. An electrical circuit board is mounted on the bottom of the polygonal branch chamber and all wiring required for control of the dampers and other components of the system are connected with this board to enable maintenance work to be conducted at a signal location. A circular inspection hole with removable cover is formed in the bottom of the polygonal branch chamber to provide easy access to its interior. The dampers are integrated into damper pipe units including actuators, opening degree regulators and other components required for damper operation, further simplifying installation and maintenance work.

15 Claims, 8 Drawing Sheets

AIR CONDITIONING DISTRIBUTION SYSTEM

BACKGROUND OF THE INVENTION

1. Field of the Invention

This invention relates to an air conditioning system and a damper pipe unit therefor and more particularly an air conditioning system and a damper pipe unit therefor which are used for heating and cooling a plurality of discrete spaces.

2. Prior Art Statement

Air conditioning systems and damper pipe units for heating and cooling a plurality of discrete spaces are disclosed, for example, in Japanese Utility Model Publication Nos. 61(1986)-22201 and 62(1987)-14519, Japanese Patent Publication No. 50(1975)-374546 and Japanese Patent Public Disclosures 50(1975)-91937, 57(1982)-196029 and 62(1987)-37633.

When one or more air conditioner units are used for heating and cooling a plurality of discrete spaces such as the rooms of a building, it has been generally necessary to supply the conditioned air to the individual rooms via ducts.

In the conventional air conditioning systems, certain problems arise depending on the distance between the air conditioning unit and the respective rooms and the layout of the ducts with respect to the individual rooms. Among these are, for instance, that the amount of conditioned air delivered tends to vary between different rooms, adjustment of the amount of delivered air is complex operationally and/or in terms of equipment installation, unpleasant noise produced by the throttling action of dampers provided within the ducts and by the operation of the dampers themselves can be heard within the rooms, and crosstalk can be heard between two separate rooms when the dampers for both are simultaneously open.

From the point of efficiency in operation, installation and maintenance, the conventional systems have also been in need of improvement as regards the mounting of the electrical control boards for damper opening/closing and other types of control, the wiring layout among the various units, and the mounting of the dampers.

The general practice has been to provide dampers in the ducts of the air conditioning system and to use these dampers for adjusting the cross-sectional area of the duct passages to thereby adjust the passage of air, the amount of conditioned air delivered and the like. The degree of damper opening has been controlled by the use of actuators or the like.

However, since in the conventional air conditioning systems the dampers are unitarily fixed to the ducts and the like, the efficiency of inspection and maintenance work has been bad both for the dampers and their actuators.

It has further been the conventional practice to change the degree of damper opening by replacing a stop member or the like. The efficiency of this work in actual on-site situations is, however, quite poor and, moreover, the stops can provide only stepwise adjustment, making it difficult to obtain uniform air flow rates.

These problems are particularly pronounced in the case of an air conditioning system in which a large number of ducts for heating and cooling a plurality of discrete spaces have to be installed, serviced and repaired.

OBJECT AND SUMMARY OF THE INVENTION

In view of the aforesaid problems of conventional air conditioning systems, the first object of this invention is to provide an air conditioning system which enables conditioned air to be supplied to a plurality of discrete spaces to be heated or cooled at the most uniform delivery rate and temperature possible and which prevents talk or noise from propagating between different rooms via the system ducts.

The second object of this invention is to provide an air conditioning system in which the mounting position of an electrical circuit board is so chosen as to improve the efficiency of the work of inspecting and repairing the same and to increase the service life of the electrical circuit board.

The third object of this invention is to provide an air conditioning system in which the electrical wiring from the vents and the electrical connector box is simplified and the number of maintenance holes is reduced, so as to enable the installation, inspection and repair of the circuits and components to be conducted at a single location, thereby improving the efficiency and accuracy of these operations and providing a more attractive appearance.

The fourth object of this invention is to provide an air conditioning system in which the efficiency of the work of installing, inspecting, servicing and repairing the system dampers and actuators is improved.

The first object of the invention is attained by the first aspect of the invention which provides an air conditioning system comprising an air conditioning unit, a blower for blowing conditioned air, a polygonal branch chamber of prescribed volume, a main duct for delivering conditioned air from the blower to the polygonal branch chamber, and branch ducts for delivering the conditioned air from the polygonal branch chamber to a plurality of discrete spaces, each duct being provided with a damper.

The second object of the invention is attained by the second aspect of the invention which provides an air conditioning system comprising an air conditioning unit, a blower for blowing conditioned air, a polygonal branch chamber of prescribed volume having an inspection hole covered by a removable cover, a main duct for delivering conditioned air from the blower to the polygonal branch chamber, branch ducts for delivering the conditioned air from the polygonal branch chamber to a plurality of discrete spaces, each branch duct being provided with a damper, and an electrical circuit board for controlling at least said dampers mounted on the outer bottom surface of said cover.

The portion at which the electrical circuit board is mounted is formed of or provided with heat insulating material so as to protect the electrical circuit board from the temperature changes within the branch chamber.

The second object of the invention is also attained by the third aspect of the invention which provides an air conditioning system similar to that according to the second aspect but wherein the chamber inspection hole provided in the bottom of the polygonal branch chamber is given a circular configuration. By mounting the polygonal branch chamber so that the circular chamber inspection hole appears as an inscribed circle within the ceiling inspection hole, the combination of the two inspection holes enables inspection and repair work to be carried out with improved efficiency.

The third object of the invention is attained by the fourth aspect of the invention which provides an air conditioning system comprising an air conditioning unit, a blower for blowing conditioned air, a polygonal branch chamber of prescribed volume having an inspection hole covered by a removable cover, a main duct for delivering conditioned air from the blower to the polygonal branch chamber, branch ducts for delivering the conditioned air from the polygonal branch chamber to a plurality of discrete spaces, each branch duct being provided with a damper, an electrical circuit board for controlling at least said dampers mounted on the branch chamber, and controller units provided in each of the discrete spaces, wires from connectors of all of the controller units converging on and being connected with the electrical circuit board.

The third object of the invention is also attained by the fifth aspect of the invention which provides an air conditioning system similar to that according to the fourth aspect but wherein wires from an electrical box are converged on and connected with the electrical circuit board for further simplifying the wiring layout.

The third object of the invention is also attained by the sixth aspect of the invention which provides an air conditioning system similar to that according to the fourth aspect but wherein wires from vents provided in the respective discrete spaces are converged on and connected with the electrical circuit board for further simplifying the wiring layout.

The fourth object of the invention is attained by the seventh aspect of the invention which provides a damper pipe unit for an air conditioning system comprising a cylindrical main body, a damper for controlling the crosssectional passage area of the main body, a flange formed on the outer periphery of the main body and adapted for attachment to a predetermined mounting location and an actuator for opening and closing the damper.

The fourth object of the invention is also attained by the eighth aspect of the invention which provides a damper pipe unit for an air conditioning system similar to that according to the sixth aspect of the invention but wherein the flange is provided with elongated mounting portions for engagement with mounting members provided at the predetermined mounting location and the actuator is mounted on a portion of the flange rotatable together with the main body within a plane lying perpendicular to the axis of the main body. With this arrangement the weight of the actuator produces a moment acting on the damper pipe unit to prevent detachment thereof.

It is further possible to provide a damper opening regulator on the main body so as to enable stepless adjustment of the damper opening in a simple manner.

The operation of the embodiments according to the aforesaid aspects of the invention will now be explained.

In the air conditioning system according to the first aspect of the invention, the conditioned air is supplied to the respective rooms via a polygonal branch chamber of a prescribed volume. Therefore, sound waves which might be expected to propagate from one room through the branch chamber into another room are attenuated by the space which is defined by the branch chamber and spreads out in the direction of propagation thereof, so that the probability of noise reaching another room becomes extremely small. Moreover, air throttling noise arising with the opening and closing of the damper and operational noise of the damper itself are similarly attenuated upon propagating to the branch chamber, making it possible to lower the noise level of the individual rooms. Further, since the conditioned air supplied to the branch chamber from the air conditioning unit once diffuses or expands within the space determined by the prescribed volume of the branch chamber and is thereafter supplied to the discrete spaces, the supply of the conditioned air will be little affected by the distance of the rooms from the air conditioning unit or their locations so that nearly the same amount of conditioned air will be supplied to each room.

In the air conditioning system according to the second aspect of the invention, the electrical circuit board is mounted not within the branch chamber but on the outer bottom surface thereof. As a result, the electrical circuit board can be accessed through the ceiling inspection hole for inspection and repaired simply by removing the ceiling inspection hole cover, without need for removing a chamber inspection hole cover, as has conventionally been required, and also without being required to carry out the work within a cramped space.

Further, as the electrical circuit board is disposed outside the branch chamber, it enjoys a prolonged service life since it is unaffected by temperature differences arising during heating and cooling.

In the air conditioning system according to the third aspect of the invention, since the chamber inspection hole is made circular, lowering of working efficiency which has conventionally arisen when there is even a slight misalignment of the chamber inspection hole and the ceiling inspection hole can be minimized, and the serviceman does not experience difficulty in reaching the components requiring inspection or maintenance.

It is particularly advantageous for the circular chamber inspection hole to be made such that it appears as an inscribed circle within the ceiling inspection hole since in this case it is relatively easy to secure space for insertion of the hands into the interior of the branch chamber through the ceiling inspection hole and the chamber inspection hole irrespective of the orientation of the branch chamber.

In the air conditioning system according to the fourth to sixth aspects of the invention, since the wire from the connectors in all of the discrete spaces are converged on and connected with the electrical circuit board mounted on the branch chamber, all of the inspection and repair work can be carried out at the bottom of the branch chamber or through the inspection hole formed in the ceiling (the chamber inspection hole or the ceiling inspection hole).

As a result, wiring errors are less likely to occur and once the wiring is completed, it can be rechecked with ease at a single location, namely at the electrical circuit board on the branch chamber, during subsequent inspection, repair and the like. Such maintenance work can thus be conducted with good efficiency.

Moreover, since there is no need to provide a maintenance hole in every discrete space, the overall air conditioning system can maintain a good appearance and modifications in the layout of the vents can be accommodated.

In the air conditioning system damper pipe unit according to the seventh aspect of the invention, since the damper and the other various components required for the damper to manifest its function are all integrated in a single pipe unit, they can be treated as a single component, thus simplifying their maintenance, repair and the like.

In the air conditioning system damper pipe unit according to the eighth aspect of the invention, since the actuator is mounted on a portion of the flange rotatable together with the main body within a plane lying perpendicular to the axis of the main body, the damper pipe unit can be attached and detached merely by rotating its main body.

Moreover, since a damper opening regulator for adjusting the degree of opening of the damper is provided on the main body, stepless adjustment of the damper opening degree is possible and, because of its provision on the main body, the damper opening regulator can be considered as an integral part of the damper pipe unit and need not be treated separately.

The above and other features of the present invention will become apparent from the following description made with reference to the drawings.

DETAILED DESCRIPTION OF THE PREFERRED EMBODIMENTS

Figure 1:
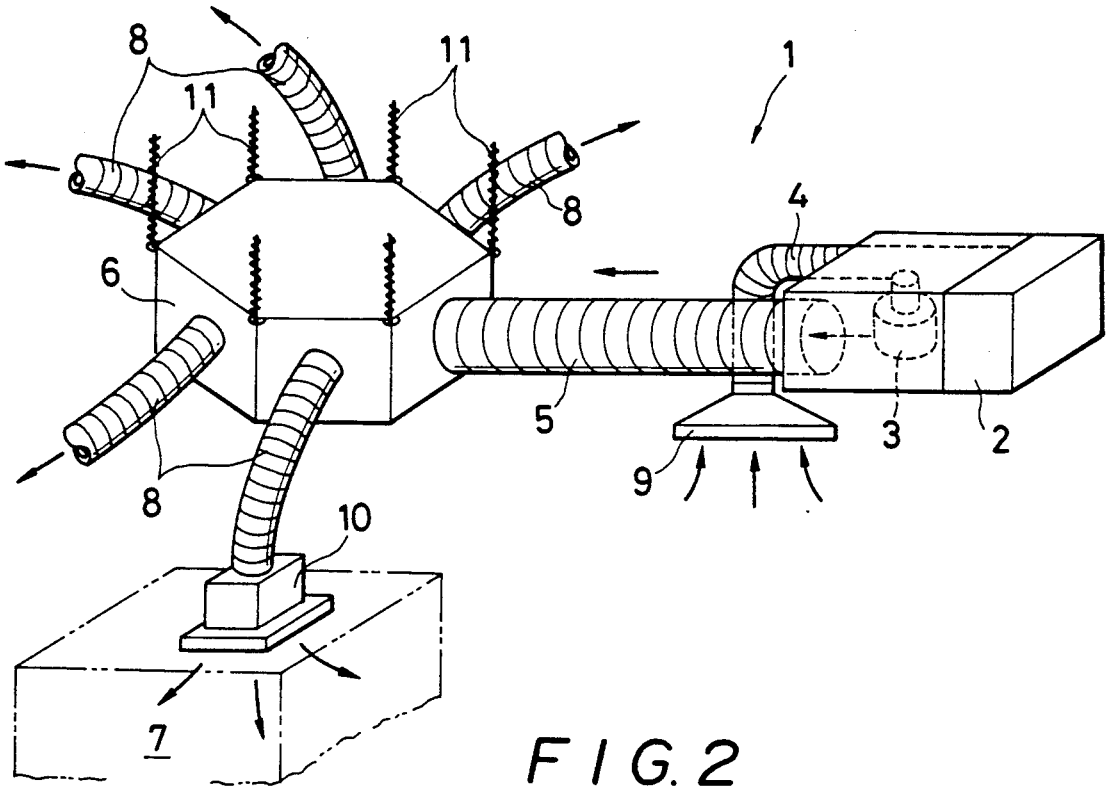
FIG. 1 is a perspective view of the basic structure of one embodiment of the air conditioning system according to the present invention.

An embodiment of the air conditioning system according to the first aspect of this invention will now be described with reference to FIGS. 1 to 3.

The air conditioning system, generally designated by reference numeral 1, comprises an air conditioning unit 2, a blower 3 for blowing conditioned air, an air intake duct 4 connected with the air conditioning unit 2, a main duct 5, a polygonal (e.g. six-sided) branch chamber 6 connected with the main duct 5, and a plurality of branch ducts 8 connected between the branch chamber 6 and the individual rooms (discrete spaces) 7. The air intake duct 4 is connected with an air intake port 9 and each of the branch ducts 8 has a vent 10 attached to its end at the room 7 to be air conditioned. The reference numeral 11 indicates suspension members, electrical wiring and the like.

Figure 2:
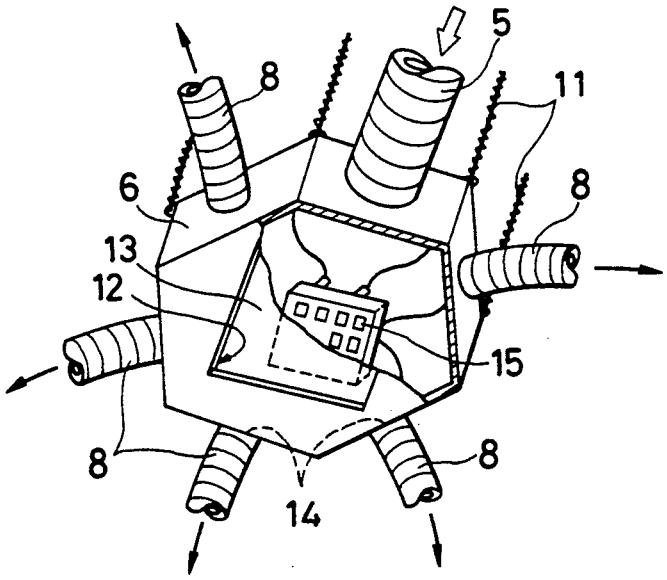
FIG. 2 is a partially cut-away perspective view of the branch chamber of the embodiment of FIG. 1.

Referring to FIG. 2, the branch chamber 6 has an inspection hole 12 provided in its floor. The inspection hole 12 is closed by a removable cover 13 which can be opened to allow inspection of the interior of the branch chamber 6. An adjustable damper 14 is provided in each of the branch ducts 8 at the end thereof attached to the branch chamber 6 and an electrical circuit board 15 for adjusting the degree of opening of these dampers 14 and other control operations is mounted on the ceiling of the branch chamber 6.

Figure 3:
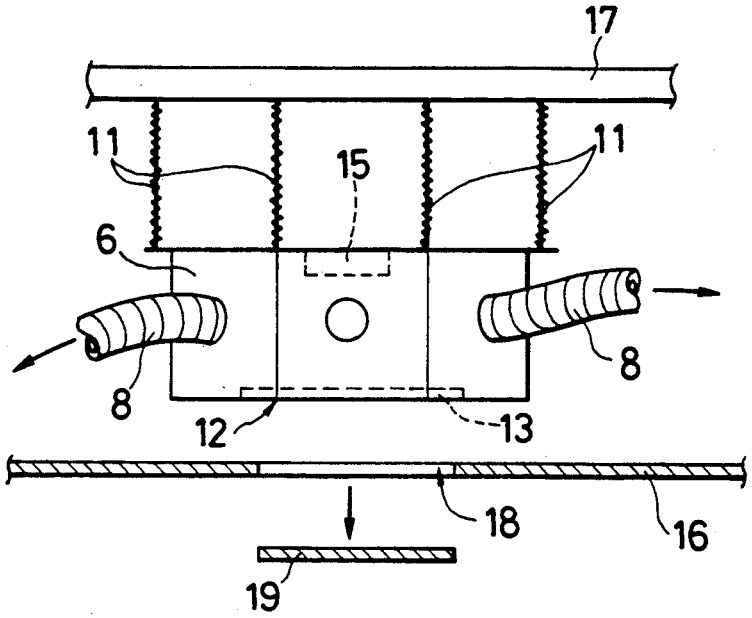
FIG. 3 is a side view of the same.

As shown in FIG. 3, the branch chamber 6 is generally suspended from a beam or the like above the ceiling 16 of the structure (building). Reference numeral 18 designates a ceiling inspection hole and reference numeral 19 designates a cover plate for closing the ceiling inspection hole.

In this air conditioning system 1, since the branch chamber 6 is of polygonal shape and the branch ducts 8 are connected with the branch chamber 6 at analogous positions, the air pressure, air flow rate etc. within the branch chamber 6 are made uniform so that no substantial difference arises in the pressure and flow rate of the conditioned air blown into the respective rooms 7, which is to say that the distribution of the conditioned air is stable.

Moreover, even if noise should pass from one or more of the branch ducts 8 into the branch chamber 6, the sonic wave energy thereof will be attenuated by the space which is defined within the branch chamber 6 and spreads out in the direction of propagation thereof so that air noise and operational noise arising when the dampers 14 are regulated is reduced and crosstalk between rooms is prevented. Quiet air conditioning is thus ensured.

Further, since the dampers 14 can be centrally controlled, the wiring is simplified.

In this aspect of the invention, the number of sides of the branch chamber can be freely selected and the pattern of guides for flow rate distribution can also be selected as desired.

The provision of the electrical circuit board 15 and the chamber inspection hole 12 in the aforesaid manner does, however, entail certain problems.

One of these is that during operation of the air conditioning system 1 the electrical circuit board 15 is exposed to the heated or cooled air passing through the branch chamber 6 and is thus subjected to temperature changes which shorten its service life.

Another is that for servicing or repairing the electrical circuit board 15 when it requires maintenance or breaks down, the serviceman is each time required to open the chamber inspection hole 12 and insert his hands into the branch chamber 6 for conducting the required adjustment or repair. The maintenance and repair work thus cannot be conducted efficiently and requires considerable time.

Still another is the difficulty of installing the branch chamber 6 so that chamber inspection hole 12 will register precisely with the ceiling inspection hole 18 formed in the ceiling 16 located below the branch chamber 6.

Figure 4:
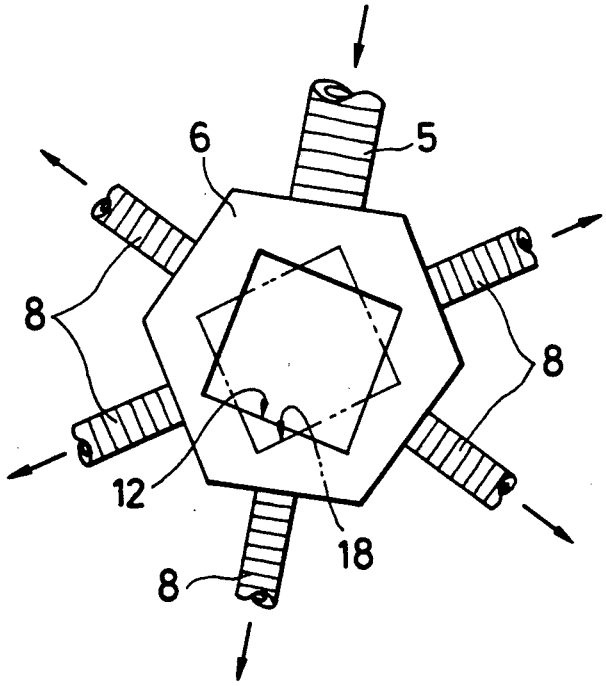
FIG. 4 is a bottom view of the same.

When the positions of the branch chamber 6 and the ceiling inspection hole 18 are out of registration as shown in FIG. 4, the amount of overlapping area between the chamber inspection hole 12 and the ceiling inspection hole 18 is reduced so that it becomes difficult or impossible to remove the cover 13 from the chamber inspection hole 12 after removing the cover plate 19 from the ceiling 16. Even if the cover 13 can be removed, it is then difficult or impossible for the serviceman to insert his hands into the branch chamber 6. Thus it becomes difficult for the serviceman to carry out the inspection, maintenance and repair work.

The second and third aspects of the present invention provide air conditioning systems for overcoming these disadvantages of the system according to the first aspect of the invention.

These aspects of the invention will now be explained with reference to the air conditioning system 20 shown in FIGS. 5 to 7. Components in FIGS. 5 to 7 which ar similar to those in FIGS. 1 to 4 are assigned the same reference numerals as those in FIGS. 1 to 4 and will not be explained further here.

Figure 5:
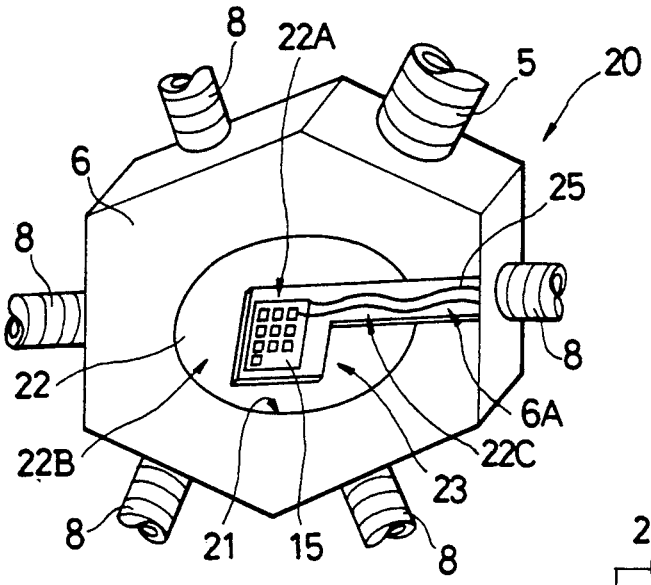
FIG. 5 is a perspective view from below of the branch chamber used in air conditioning systems in accordance with embodiments of the second and third aspects of this invention.
Figure 6:
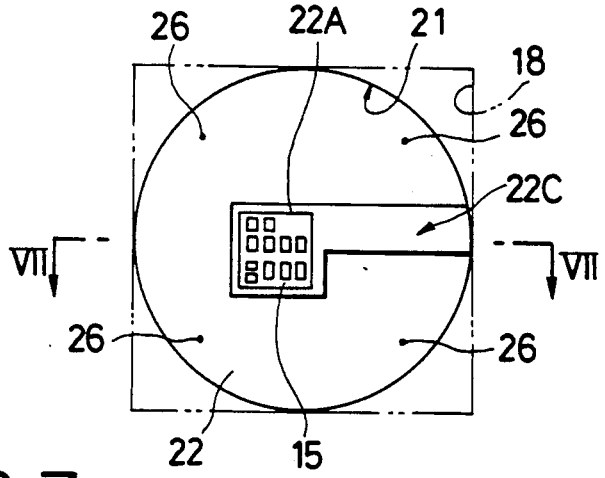
FIG. 6 is a bottom view of the essential portion of the branch chamber of FIG. 5.
Figure 7:
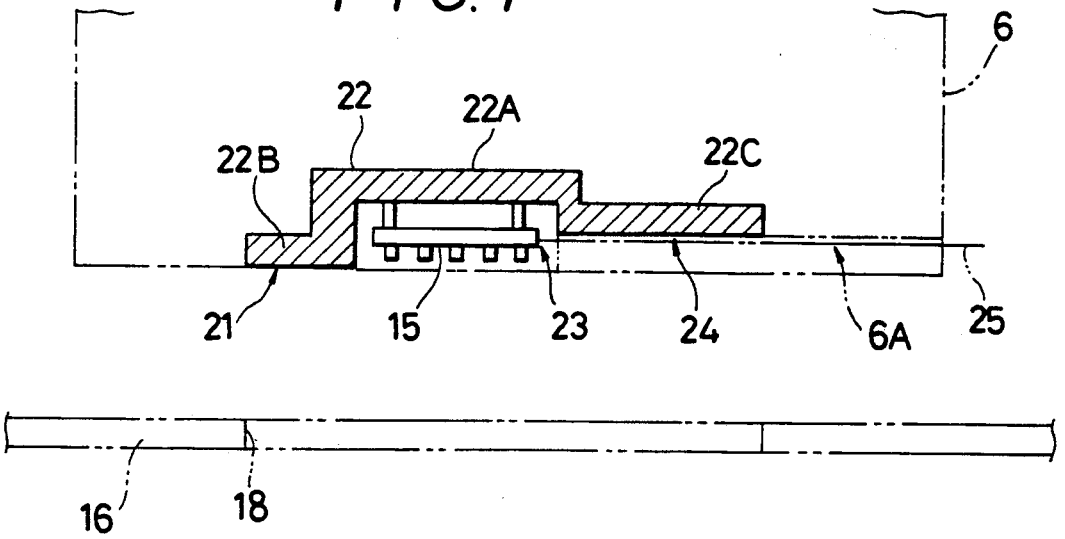
FIG. 7 is a sectional view taken along line VII—VII of FIG. 6.

FIG. 5 is a perspective view from below of the branch chamber 6 of the air conditioning system 20, FIG. 6 is a bottom view of the essential portion of the branch chamber 6, and FIG. 7 is a sectional view taken along line VII—VII of FIG. 6.

The branch chamber 6 has a chamber inspection hole 21 analogous to the chamber inspection hole 12 in the first aspect of the invention but formed to be circular. The chamber inspection hole 21 is closed by a removable cover 22 analogous to the cover 13 in the first aspect of the invention, which is also formed to be circular.

At the center of the cover 22 of the chamber inspection hole 21 is mounted an electrical circuit board mount 22A that is of rectangular shape and countersunk into the branch chamber 6. At the periphery of the electrical circuit board mount 22A is provided a flat portion 22B falling within the plane of the floor of the branch chamber 6, and a passage forming member 22C is provided as countersunk with respect to the flat portion 22B so as to form a passage 24 for wiring and the like 25.

As a result, the electrical circuit board 15 can be mounted on the external bottom surface of the electrical circuit board mount 22A so as to be disposed with a mounting space 23 formed inward (upward) of the bottom of the branch chamber 6 and the passage 24 is in communication with the mounting space 23.

With this arrangement, the electrical circuit board 15 and the wiring 25 can be disposed so as to be exposed at, but not project outwardly from, the outer bottom surface of the branch chamber 6. If required, the electrical circuit board 15 can be protected by attachment of a cover (not shown).

The removable cover 22 for closing the chamber inspection hole 12 is formed of a heat insulating material so as to isolate the electrical circuit board 15 from the effect of the temperature within the branch chamber 6 as much as possible.

A passage 6A for wiring and the like is further provided in the bottom surface of the branch chamber 6 within the same plane as the aforesaid passage forming member 22C. Reference numeral 26 in FIG. 6 indicates a bolt hole for passage of a bolt (not shown) for attachment of the cover 22 for the chamber inspection hole 12.

With the air conditioning system 20 of the foregoing arrangement, the cover plate 19 need only be removed from the ceiling inspection hole 18 in the ceiling 16 to expose the electrical circuit board 15 located within the mounting space 23 so that the electrical circuit board 15 can be directly reached by hand and serviced without need to remove a cover, such as the cover 22 according to the first aspect of the invention, from the branch chamber 6.

Further, since the electrical circuit board 15 is located outside the branch chamber 6, it is little affected by the temperature or temperature changes within the branch chamber 6 during operation of the air conditioning system 20 and thus can enjoy a longer service life. In addition, as the cover of the chamber inspection hole is constituted of a heat insulating material, the effect of such temperature and temperature changes can be even further reduced.

In accordance with the second and third aspects of the invention, even though maintenance and servicing of the members other than the electrical circuit board 15, specifically of the dampers 14 and the like, have to be carried out inside of the branch chamber 6, for ensuring that this work can be carried out efficiently via the ceiling inspection hole 18, it is only necessary to mount the branch chamber 6 such that the circular chamber inspection hole 21 is in close proximity to the ceiling inspection hole 18.

Owing to the circular configuration of the chamber inspection hole 12, the branch chamber 6 can be mounted at any desired angle of rotation within the horizontal plate. The efficiency of the mounting work is improved accordingly.

The branch chamber 6 can of course be mounted at any desired angular orientation insofar as the circular chamber inspection hole 21 appear as an inscribed circle within the ceiling inspection hole 18.

Figure 8:
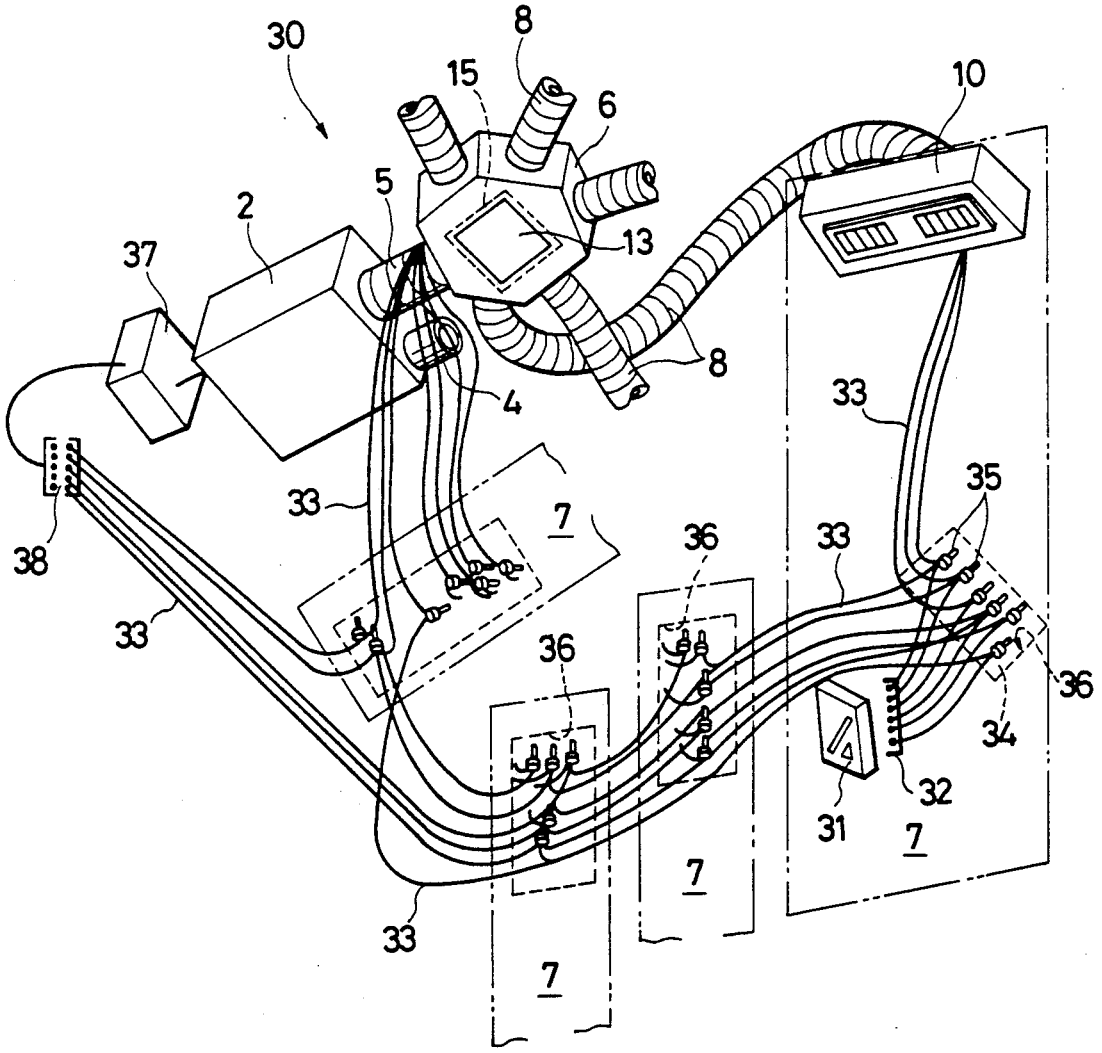
FIG. 8 is a perspective view of an air conditioning system particularly showing an example of an electrical wiring arrangement.

FIG. 8 shows an air conditioning system 30 together with an example of the arrangement of the wiring required for regulating the dampers 14 and other control operations. In the illustrated arrangement, adjustment of the degree of opening of the dampers 14 and other control operations are conducted via control units 31 provided in the respective rooms 7. It should be noted that for simplification of the explanation, the wiring shown in this figure is limited to that for a single room.

As illustrated, connectors 32 of the control units 31 are connected by wiring 33 to the terminals 35 of a connector board 34 and the connector boards 34 are connected together by the wiring 33, and then connected with the electrical circuit board 15.

The connector boards 34 are disposed at a prescribed position in the respective rooms 7 and may, for example, be disposed in a maintenance hole 36 formed at a prescribed position in the ceiling of each room, the maintenance hole 36 being openable and closable to permit inspection and repair of the connector board 34 as required.

An electrical box 37 including control circuitry for overall control of the air conditioning system 30 as well as a source of electric power is connected with the control units 31 and the electrical circuit board 15 within the branch chamber 6 via a connector 38.

Further, for enabling the control units 31 to control the opening and closing of the vents 10 and controlling the air discharge direction thereof, the terminals 35 are connected with the vent 10. By interconnecting the electrical box 37, the electrical circuit board 15 within the branch chamber 6, the vents 10 and the control units 31 by the wiring 33 in this manner, the air conditioning system 30 can be controlled as desired.

However, since wires 33 from the control units 31 of the individual rooms are connected together through the connector boards 34, the wiring is complicated and a number of maintenance holes 36 equal to number of rooms has to be provided. As a result, the efficiency of the inspection and repair work is apt to become extremely low.

What is more, since the air conditioning system 30 is installed above the ceiling, the provision of a plurality of the maintenance holes 36 should be avoided as much as possible from the point of preserving the good appearance of the rooms.

Another problem with this wiring system is that it makes it difficult to change the position of the vents 10 when the air condition system is to be modified.

For eliminating these problems, adoption of an air conditioning system in accordance with the fourth to sixth aspects of the invention is preferable.

An air conditioning system 40 in accordance with these aspects of the invention will now be explained with reference to FIGS. 9 to 12.

Figure 9:
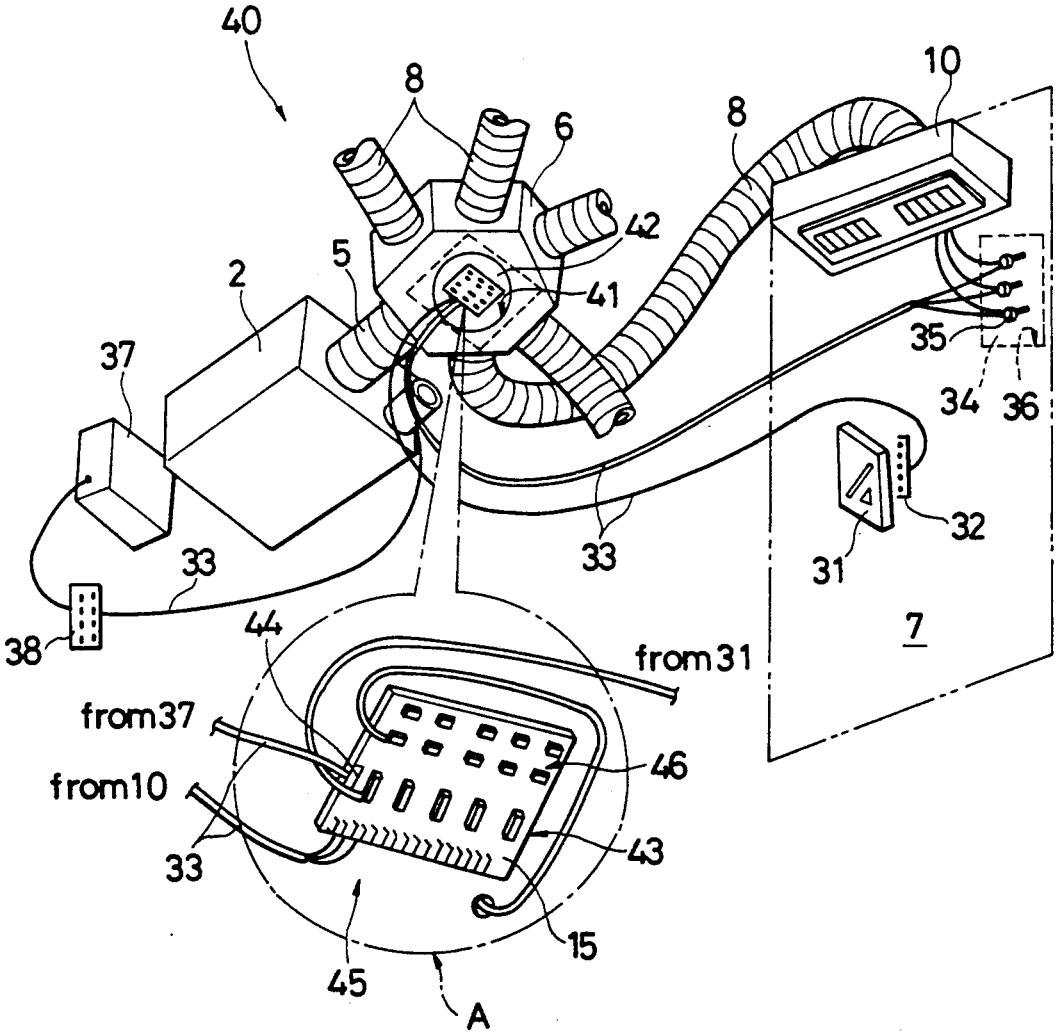
FIG. 9 is a partially cut away perspective view of an embodiment in accordance with fourth to sixth aspects of this invention, seen in the direction of the bottom of the branch chamber and particularly showing the interconnection state of the electrical wiring.
Figure 10:
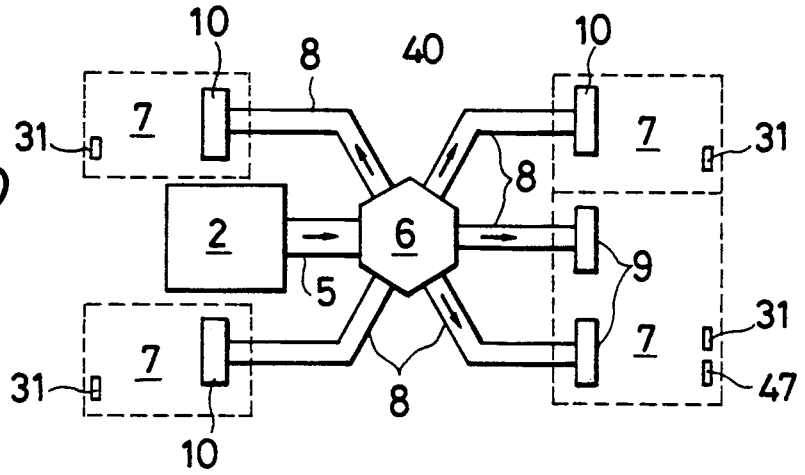
FIGS. 10 to 12 are explanatory views showing examples of how the duct and vent layout of the air conditioning system according to this invention can be readily modified.
Figure 11:
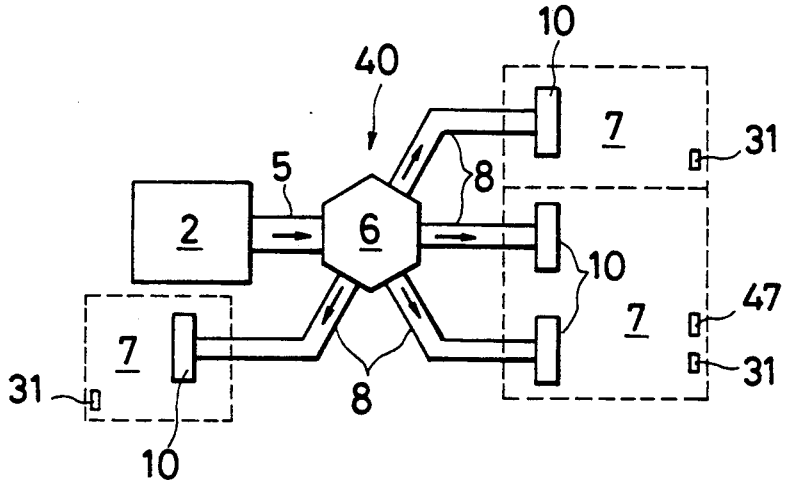
Figure 12:
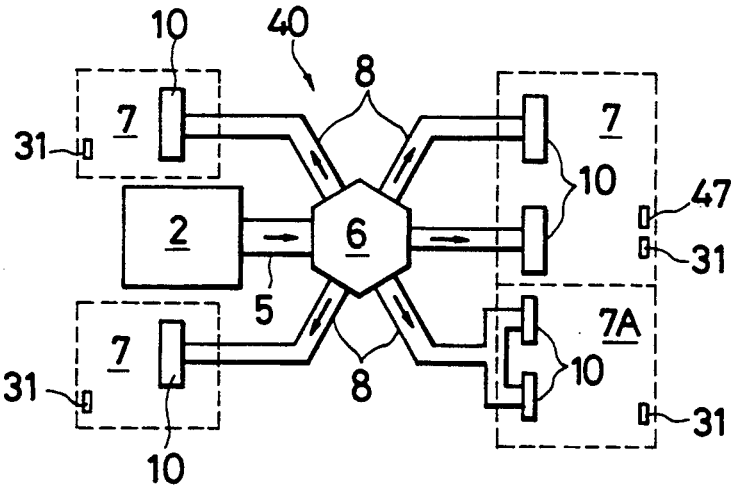

FIG. 9 is a partially cut away perspective view of the air conditioning system 40 seen in the direction of the bottom of the branch chamber and showing the interconnection state of the electrical wiring, while FIGS. 10 to 12 are explanatory views showing examples of the air conditioning systems in which the vents have modified patterns.

In the bottom of the branch chamber 6 there is formed a chamber inspection hole 41 analogous to the chamber inspection hole 12 in the first aspect of the invention but formed to be circular. The chamber inspection hole 41 is closed by a removable cover 42 analogous to the cover 13 in the first aspect of the invention, which is also formed to be circular.

The electrical circuit board 15 is mounted on the outer bottom surface of the inspection hole cover 42 so as to be exposed to the exterior. The electrical circuit board 15 can thus be accessed for inspection and repair by opening the inspection hole 18 (see FIG. 7) provided in the ceiling 16. As the chamber inspection hole 41 is formed so as to appear as an inscribed circle within the ceiling inspection hole 18, a greater degree of freedom in the mounting orientation of the branch chamber 6 is obtained and the largest possible working space is secured.

As shown in the inset A in FIG. 9, the electrical circuit board 15 has five connector members 43 for connection with the wires 33 from the connectors 32 of the control units 31 in five rooms 7, a connector member 44 for connection with the wires 33 from the connector 38 of the electrical box 37, and five sets of connector members 45 for connection with the wires 33 from the terminals 35 of the connector boards 34 of the vents 10. (In the interest of simplification, only the wires 33 from one room 7 are shown in FIG. 9.) The electrical circuit board 15 further has connectors 46 for connection with actuators (not shown) for opening the dampers 14 within the branch chamber 6.

The connector board 34 for each room is disposed within a maintenance hole 36 provided in the vicinity of the vent 10 for the room. However, it is not absolutely necessary to provide a maintenance hole 36 and a connector board 34 in every room and it is possible, for example, to provide only the minimum number thereof required for carrying out simple tests and the like. When no maintenance hole 36 is provided, the wiring from the vent 10 of the room concerned is connected directly with the connector members 45 of the electrical circuit board 15.

In this arrangement of the air conditioning system 40, the wires 33 from the respective rooms 7, the wires 33 from the electrical box 37 and the wires 33 from the vent 10 are all grouped at one central location, namely at the electrical circuit board 15. As a result, the only maintenance hole 36 that is absolutely required is one analogous to the previously mentioned ceiling inspection hole 18 ordinarily provided in the ceiling 16. Since the electrical circuit board 15 of the branch chamber 6 can be accessed for inspection and repair by hand via the ceiling inspection hole 18, it becomes possible to check the circuitry and wiring of the electrical box 37, the control units 31, vents 10 and the control units 31 all at one time at a single location. The arrangement according to this embodiment also simplifies the work of installing the air conditioning system 40.

While mounting of the electrical circuit board 15 so as to be exposed at the outer bottom surface of the branch chamber 6 makes it particularly easy to carry out inspection and repair work, it is alternatively possible, if desired, to mount the electrical circuit board 15 inside the branch chamber 6.

The fact that the installation, inspection and other such work can be carried out at a single location is also advantageous from the point that wiring errors are less likely to occur and that once the wiring is completed it can be rechecked with ease.

Moreover, the wiring can be readily modified for different layouts of the branch ducts 8 and the vents 10, as will now be explained with reference to FIGS. 10 to 12. FIG. 10 shows a layout in which five branch ducts 8 are provided one each for five vents 10 serving four rooms, a control unit 31 is provided for each room, and a main controller 47 is provided in the largest room 7.

If it should become necessary to change this layout to that shown in FIG. 11, the modification can be realized simply by removing from the electrical circuit board 15 the wires 33 for the room which no longer needs to be air conditioned and, differently from heretofore, there is no need carry out any rewiring.

On the other hand, if it should be desired to change the layout of FIG. 10 to that of FIG. 12, that is to a layout in which the number of vents 10 in room 7A is increased from one to two, this can be accomplished simply by adding another vent, without need to modify the wiring 33 at the electrical circuit board 15 or to go to the trouble of providing a maintenance hole 36 or installing a connector board 34.

A damper pipe unit in accordance with the seventh and eighth aspects of the invention will now be explained with reference to FIGS. 13 to 18.

Figure 13:
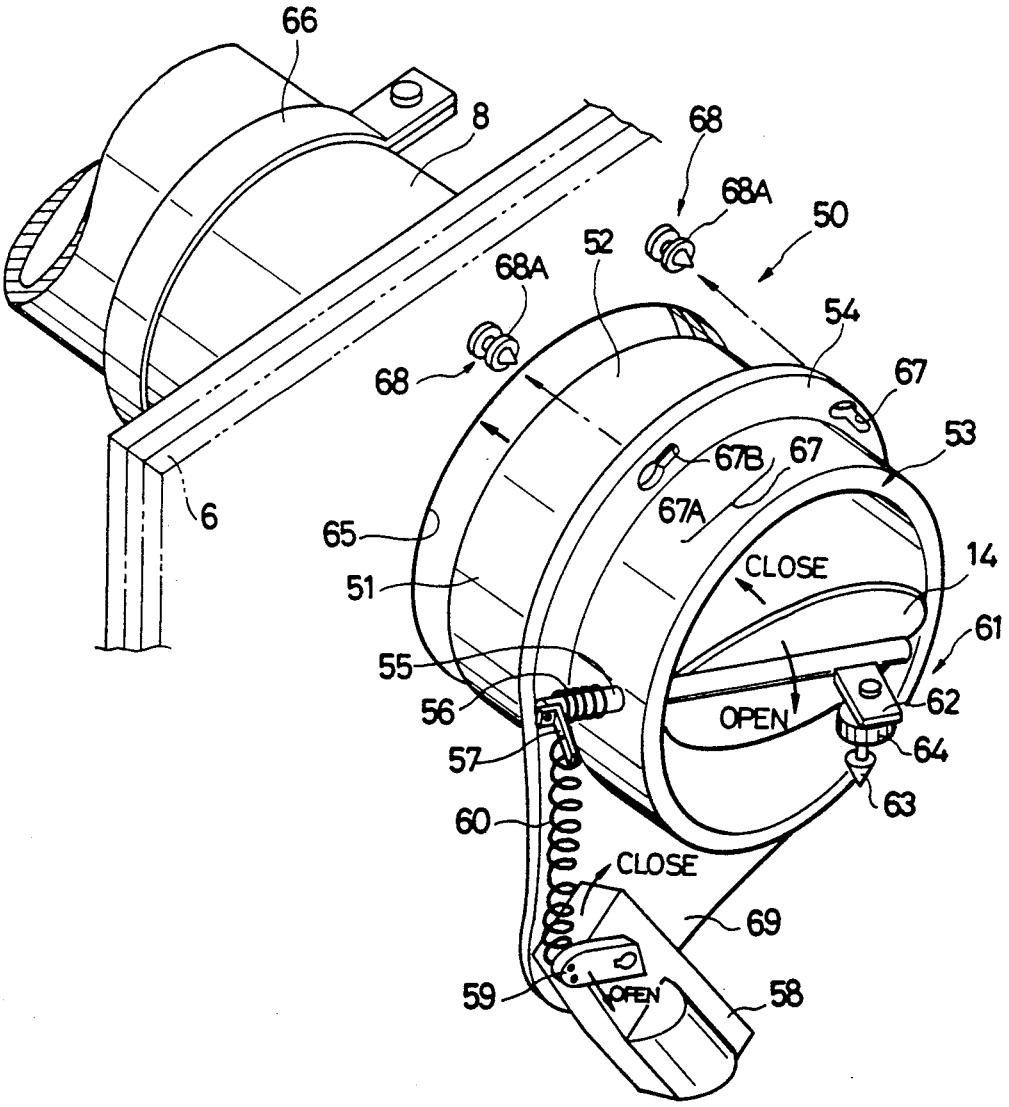
FIG. 13 is a perspective view of one embodiment of a damper pipe unit for an air conditioning system according to this invention.
Figure 14:
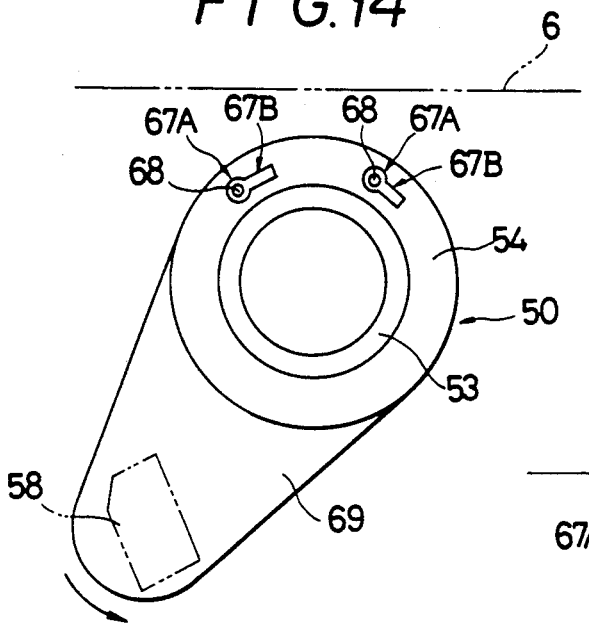
FIGS. 14 and 15 are front views for explaining the process of mounting the damper pipe unit of FIG. 13 on the branch chamber.
Figure 15:
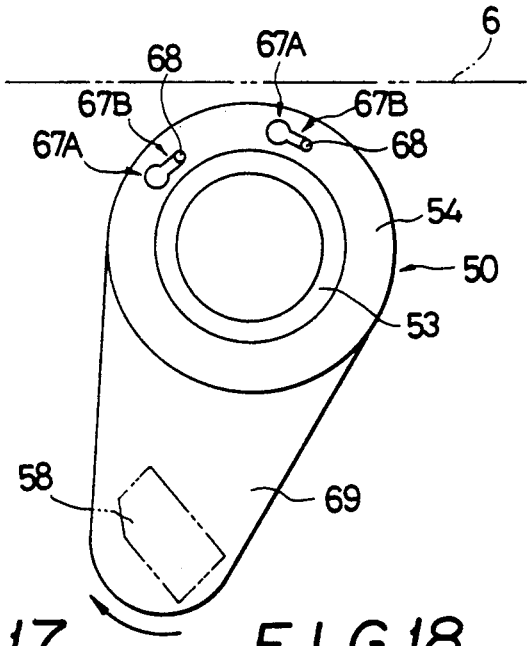

FIG. 13 is a perspective view of a damper pipe unit 50 for an air conditioning system according to one embodiment of this invention, while FIGS. 14 and 15 are front views for explaining the process of mounting the damper pipe unit 50.

As shown in FIG. 13, the damper pipe unit 50 comprises a cylindrical main body 51 of prescribed length, an open ended member 52 formed integrally with the main body 51 and destined to open into a branch duct 8, an open ended member 53 formed integrally with the main body 51 and destined to be open into the branch chamber 6, a flange 54 formed around the outer periphery of the main body 51, and a damper 14.

The damper 14 is supported on a rotary shaft 55 around which is provided a spring 56 for biasing the damper 14 in the closing direction. The rotary shaft 55 has a spring attachment projection 57 and a spring 60 for biasing the damper 14 in the opening direction is attached between the spring attachment projection 57 and the rotary projection 59 of a motor actuator 58.

A damper opening regulator 61 is provided near the opening of the open ended member 53 at a position within the rotational range of the damper 14. The damper opening regulator 61 comprises a fixed member 62 secured to the open ended member 53, an opening adjustment screw 63 that is screw-engaged with the fixed member 62 and a lock nut 64 screwed onto the fixed member 62. The positional relationship between the head of the opening adjustment screw 63 and the damper 14 can be changed by loosening the lock nut 64 and turning the opening adjustment screw 63.

The branch chamber 6 has an aperture 65 into which the open ended member 52 is inserted from the inside of the branch chamber 6 until the leading end thereof extends beyond the outer surface of the branch chamber 6 and into the branch duct 8. After the open ended member 52 has been inserted into the duct 8, the two are fixed together by tightening a clamp 66.

The open ended member 53 opens into the branch chamber 6 which is thereby put in communication with the branch duct 8 with which the open ended member 52 is coupled. The cross-sectional area of the passage within the main body 51 can be adjusted by adjusting the degree of opening of the damper 14 mounted in the open ended member 53.

The flange 54 is provided with a pair of mounting portions, specifically with a pair of elongated holes 67 each constituted of a large diameter portion 67A and an elongated portion 67B of small diameter arcuate configuration.

A plurality (e.g. a pair) of studs 68, each having a flange 68A, are provided on the inner wall of the branch chamber 6 as fixing members for engagement with the holes 67, thus making it possible to mount the flange 54 on the branch chamber 6. The diameter of the flanges 68A of the studs 68 is smaller that of the large diameter portion 67A and smaller than that of the elongated portion 67B.

The motor actuator 58 is mounted on a cam-shaped protuberance 69 formed on the flange 54. Thus the motor actuator 58 is mounted to be rotatable together with the main body 51 within a plane lying perpendicular to the axis of the main body 51.

The manner in which the damper pipe unit 50 of the aforesaid structure is coupled with the branch duct 8 and is mounted on the inner wall of the branch chamber 6 will now be explained with reference to FIGS. 14 and 15. First, as shown in FIG. 14, the damper pipe unit 50 is held in an inclined attitude so as to align the large diameter portions 67A of the holes 67 with the studs 68 and then is pushed toward the inner wall of the branch chamber 6 so as to insert the open ended member 52 through the aperture 65 and into the duct 8 and at the same time pass the large diameter portions 67A over the studs 68.

Next, if the entire damper pipe unit 50 is rotated counterclockwise from the position shown in FIG. 14, the studs 68 will pass from the large diameter portions 67A and engage with the elongated portions 67B so that the flanges 68A will come to be positioned over the elongated portions 67B, whereby the flange 54 is mounted on the branch chamber 6 (FIG. 15). The clamp 66 is then tightened to complete the mounting of the damper pipe unit 50.

When the damper pipe unit 50 is mounted in this manner, the weight of the motor actuator 58 acts as a rotating force (moment) which works to prevent detachment of the damper pipe unit 50 from the branch chamber 6.

For removing the damper pipe unit 50, it is only necessary to carry out the aforesaid procedures in reverse. Namely, after the clamp 66 has been loosened, the damper pipe unit 50 is rotated clockwise from the attitude shown in FIG. 15 so that the studs 68 will move out of the small diameter elongated portions 67B into the large diameter portions 67A and is then pulled in its axial direction away from the inner wall of the branch chamber 6. When these procedures are followed, the damper pipe unit 50 will be completely disengaged from both the branch duct 8 and the branch chamber 6.

With this arrangement, the damper pipe unit 50 can be attached and detached by simple operations without need for any tool. Moreover, since all components that might require inspection and repair are included in a single unit, the maintenance work can be conducted with improved efficiency.

Figure 16:
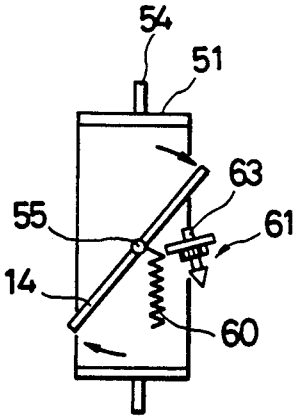
FIGS. 16 to 18 are sectional views of the essential portion of a damper showing the manner in which the damper opening is adjusted.
Figure 17:
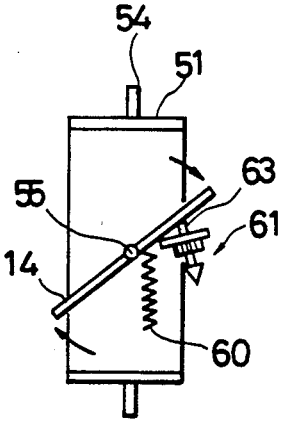
Figure 18:
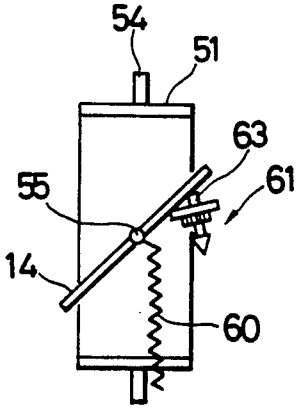

FIGS. 16 to 18 are sectional views of the essential portion of the damper 14 showing the manner in which the damper opening is adjusted. As was explained earlier, the degree of damper opening is determined by the position of an opening adjustment screw 63. The damper 14 is arranged such that the cross-sectional area of the passage is increased by clockwise rotation as seen in the figures.

The spring 60 provides a prescribed tensile force which at the time of maximum valve opening is larger than the tensile force of the spring 56 biasing the damper 14 in the closing direction but is smaller than the operating force of the rotary projection 59 of the motor actuator 58. Thus in the states shown in FIGS. 16 and 17, the spring 60 maintains its normal relaxed length.

After the damper 14 has come into abutment with and stopped at the head of the opening adjustment screw 63 of the damper opening regulator 61, further operation of the motor actuator 58 will not cause the damper 14 to open further but will only cause the spring 60 to stretch. This maximum opening of the damper 14 can be steplessly adjusted as desired over a range of 90° between the fully closed position and the fully open position by loosening or tightening the opening adjustment screw 63.

Further, rotation of the damper 14 in the closing direction is possible by first actuating the motor actuator 58 to cause the rotary projection 59 to rotate in the clockwise direction as seen in FIG. 13 until the spring 60 assumes its normal unstretched length, whereafter the damper 14 will separate from the opening adjustment screw 63 and be rotated in the closing direction by the energizing force of the spring 56.

While in the foregoing embodiment, the flange 54 is provided with elongated through-holes for engagement with the studs 68, this is not limitative and the trough-holes may be replaced with elongated grooves. Moreover, the shape and positioning of the cam-shaped protuberance is not limited to that illustrated but may be freely selected. Further, other types of actuators than the exemplified motor actuator can be used instead.

It should also be noted that the pipe unit according to this aspect of the invention can, if desired, be mounted at other places than on the branch chamber and, in particular, can be installed within a duct, vent or air intake port so that it can be used not only for controlling air delivery but also for controlling air intake.

As has been explained in the foregoing, the provision of the branch chamber in accordance with the present invention enables attenuation of noise from the rooms being served by the air conditioning system and operational noise from the system itself, thus ensuring quiet operation, and, moreover, stabilizes the distribution of conditioned air supplied from the air conditioning unit to the vents, thereby making the air conditioning system appropriate for the air conditioning of a plurality of discrete spaces.

As in accordance with the second aspect of the invention the electrical circuit board is mounted on the outer bottom of the branch chamber, maintenance, inspection and repair of the electrical circuit board can be carried out without need to remove the cover of the inspection hole. Moreover, the service life of the electrical circuit board can be prolonged.

As in accordance with the third aspect of the invention the chamber inspection hole is given a circular configuration, it becomes relatively easy to secure space for insertion of the hands into the interior of the branch chamber for carrying out inspection and repair work.

As in accordance with the fourth to sixth aspects of the invention the electrical circuit board is mounted on the branch chamber and the wires from all of the controller units are converged on and connected with the electrical circuit board, it becomes easy to carry out installation, inspection and repair work, wiring errors can be reduced, modification of the vent layout and other changes in the air conditioning system can be readily accommodated, and the number of maintenance holes can be reduced to ensure a more attractive system.

As according to the seventh and eighth aspects of the invention there is provided a damper pipe unit which integrates the damper and all components required for the mounting thereof, attachment and detachment of the damper and related components can be carried out with ease. Further, since the actuator is mounted on a portion of the flange rotatable together with the main body within a plane lying perpendicular to the axis of the main body 51, the damper pipe unit is protected from accidental detachment after it has once been mounted.

What is claimed is:

1. An air conditioning system comprising:

an air conditioning unit, a blower for blowing conditioned air, a polygonal branch chamber of prescribed volume having an inspection hole in its bottom surface covered by a removable cover, a main duct for delivering conditioned air from the blower to the polygonal branch chamber, a plurality of branch ducts provided with respective dampers and connected between the polygonal branch chamber and a plurality of discrete spaces for delivering the conditioned air from the polygonal branch chamber to the plurality of discrete spaces, and an electrical circuit board providing means for controlling said respective dampers of the branch ducts, said electrical circuit board being mounted on the outer bottom surface of said cover.

2. An air conditioning system according to claim 1, wherein the branch chamber is suspended from a beam of the air conditioned structure.

3. An air conditioning system according to claim 1 wherein said cover is provided with an electrical circuit board mount formed to be countersunk inward from the bottom surface of the polygonal chamber to form a mounting space.

4. An air conditioning system according to claim 2 wherein a countersunk passage for wires is formed in said cover to communicate with the mounting space.

5. An air conditioning system in accordance with claim 4 wherein a countersunk passage for wires is formed in the bottom surface of the polygonal branch chamber to communicate with the countersunk passage formed in said cover.

6. An air conditioning system according to claim 1 wherein said cover is constituted of a heat insulating material.

7. An air conditioning system according to claim 1 wherein the polygonal branch chamber inspection hole covered by a removable cover is of circular configuration.

8. An air conditioning system according to claim 1, wherein said polygonal branch chamber is provided in its bottom surface with a chamber inspection hole of circular configuration.

9. An air conditioning system according to claim 8 wherein the branch chamber is suspended from a beam of the air conditioned structure with the chamber inspection hole vertically aligned with a ceiling inspection hole in a ceiling beneath the beam.

10. An air conditioning system according to claim 1, further comprising:

controller units provided in the respective discrete spaces, and wires from connectors of all of the controller units converging on and being connected with the electrical circuit board.

11. An air conditioning system according to claim 1, further comprising:

an electrical box having control circuitry and a source of electric power, and wires from a connector of the electrical box converging on and being connected with the electrical circuit board.

12. An air conditioning system according to claim 1, further comprising:

vents for supplying conditioned air to the individual discrete spaces, and wires from a connector of the vents converging on and being connected with the electrical circuit board.

13. An air conditioning system according to claim 10 wherein a connector is provided on the electrical circuit board for connection with actuators for opening and closing said respective dampers provided in the branch ducts.

14. An air conditioning system according to claim 11 wherein a connector is provided on the electrical circuit board for connection with actuators for opening and closing said respective dampers provided in the branch ducts.

15. An air conditioning system according to claim 12 wherein a connector is provided on the electrical circuit board for connection with actuators for opening and closing said respective dampers provided in the branch ducts.

* * * * *